US008684181B2

(12) United States Patent
Hu

(10) Patent No.: US 8,684,181 B2
(45) Date of Patent: Apr. 1, 2014

(54) TRAY FOR PACKAGING LCD ASSEMBLIES

(75) Inventor: Qianshuang Hu, Shenzhen (CN)

(73) Assignee: Shenzhen China Star Optoelectronics Technology Co., Ltd., Shenzhen (CN)

( * ) Notice: Subject to any disclaimer, the term of this patent is extended or adjusted under 35 U.S.C. 154(b) by 0 days.

(21) Appl. No.: 13/512,677

(22) PCT Filed: Apr. 28, 2012

(86) PCT No.: PCT/CN2012/074879

§ 371 (c)(1),
(2), (4) Date: May 30, 2012

(87) PCT Pub. No.: WO2013/143200

PCT Pub. Date: Oct. 3, 2013

(65) Prior Publication Data

US 2013/0256185 A1 Oct. 3, 2013

(30) Foreign Application Priority Data

Mar. 30, 2012 (CN) ..... 2012 1 0089508

(51) Int. Cl.
*B65D 85/48* (2006.01)

(52) U.S. Cl.
USPC ..... 206/454; 206/710

(58) Field of Classification Search
USPC ..... 206/449–455, 521, 523, 557–565, 206/585–594, 710–712; 118/500, 501; D3/313, 314; D9/434, 456
See application file for complete search history.

(56) References Cited

U.S. PATENT DOCUMENTS

D263,268 S * 3/1982 Rein ..... D9/424
(Continued)

FOREIGN PATENT DOCUMENTS

CN 101293576 A 10/2008
(Continued)

OTHER PUBLICATIONS

Li Yulin, the International Searching Authority written comments, Jan. 2013, CN.
Fan Xiaomin, the first office action, Jul. 2013, CN.

*Primary Examiner* — Bryon Gehman
(74) *Attorney, Agent, or Firm* — IPro, Inc.; Na Xu

(57) ABSTRACT

The invention provides a tray for packaging LCD assemblies, which includes a bottom plate. The bottom plate is provided with a plurality of rhombic grooves which are arranged side by side, and a plurality of discharge grooves for buffering stress concentration are arranged around the rhombic grooves. Because the bottom plate of the tray of the invention is designed with various types of stress concentration factors which are mutually associated, and the rhombic grooves of the stress concentration factors form a plurality of stress concentration zones on the bottom plate of the tray, the stress concentration in the center of the bottom plate can be effectively decreased. In addition, the discharge grooves are arranged around the rhombic grooves in the invention, and the stress concentration of the rhombic grooves is decreased by the discharge grooves. By the design of the aforementioned stress concentration factors, the stress and strain in the center of the bottom plate of the tray can be decreased, thereby preventing the tray from deforming largely because of excessive stress concentration to damage the LCD assemblies.

15 Claims, 11 Drawing Sheets

(56) References Cited

U.S. PATENT DOCUMENTS

| | | | | | |
|---|---|---|---|---|---|
| D283,012 | S | * | 3/1986 | Jankens | D9/456 |
| D284,841 | S | * | 7/1986 | Rowland et al. | D9/456 |
| 4,674,414 | A | | 6/1987 | Nulle et al. | |
| 5,085,758 | A | * | 2/1992 | Guadagno et al. | 206/449 |
| D475,625 | S | * | 6/2003 | Lin | D9/456 |
| 7,153,365 | B2 | * | 12/2006 | Aoki | 118/500 |
| 7,588,150 | B2 | * | 9/2009 | Kasama | 206/710 |
| 7,731,029 | B2 | * | 6/2010 | Su | 206/454 |
| 7,854,327 | B2 | * | 12/2010 | Hyobu | 206/710 |
| 2013/0098800 | A1 | * | 4/2013 | Rehmanji et al. | 206/557 |

FOREIGN PATENT DOCUMENTS

| | | | |
|---|---|---|---|
| CN | 20100915 | U | 9/2010 |
| CN | 201660183 | U | 12/2010 |
| CN | 201901295 | U | 7/2011 |
| GB | 2293161 | A | 3/1996 |
| JP | 5-319434 | A | 12/1993 |
| JP | 2001-354241 | A | 12/2001 |
| JP | 2003-165525 | A | 6/2003 |
| TW | 201206786 | A1 | 2/2002 |
| TW | 201041789 | A1 | 12/2010 |

* cited by examiner

TRAY FOR PACKAGING LCD ASSEMBLIES

TECHNICAL FIELD

The invention relates to the field of liquid crystal displays (LCDs), and more particularly to a tray for packaging LCD assemblies.

BACKGROUND

Electronic products have characteristics of complicated structure, high value, rapid update, and so on, and the supply chains thereof are complicated among manufacturers. In terms of the production and marketing modes of the conventional electronic products, most products are produced, assembled, and distributed in different places, respectively, so that the parts, the semi-finished products and the like of the electronic products have to be transported among manufacturers. Take LCD industry as an example, the raw materials of LCD products, the production of panels of LCD products, the assembly of panel components, the assembly of LCD modules, and LCD televisions may be respectively conducted in different countries or regions, or in different factories, or by different manufacturers in the same region, resulting in the problem of packaging and transporting the LCD panels, panel components, or LCD modules.

FIG. 1 and FIG. 2 show a schematic diagram of a package for LCD assemblies. At present, a tray 100 is often used to carry LCD assemblies in processing of package. The LCD assemblies 200 include an LCD panel, a flexible connector, and a circuit board. The tray 100 is formed by plastic injection, plastic suction, and so on. A frequently-used tray is formed by plastic suction. A buffer underlay 120 is added between the LCD assemblies 200 to buffer pressure, separate LCD assemblies, and resist static electricity. If the inner structure of the tray is different, the anti-deformation capacity thereof is different. FIG. 2 shows a schematic diagram of packaged LCD assemblies. The inner structure of the tray can be designed according to the actual number of arranged LCD assemblies.

To increase the bearing capacity of the tray, the bottom plate of the tray is generally designed with corresponding textures, to prevent stress from being concentrated at the bottom of the tray, and then prevent the LCD assemblies from being damaged when oversize stress is generated at the bottom of the tray. The conventional tray for packaging LCD assemblies mainly includes the following structures:

FIG. 3 and FIG. 4 show a structure of a first tray in the prior art. A bottom plate of the tray 100 is provided with a plurality of long rectangular grooves 103 which are distributed on the bottom plate of the tray 100 side by side. FIG. 5 and FIG. 6 respectively show analysis diagrams of stress and strain obtained by ANSYS static compression simulation of the first tray under the condition of the following parameters: poisson ratio of 0.41, elastic modulus of 2,200 MPa, mesh size of 15 mm, applying fixed constraints to the bottom surface, and applying pressure of 0.00016 Mpa to the plane of the bottom plate. As shown in the Figures, the maximum stress of the first tray is 1.7593 MPa, and the maximum strain is 2.7575 mm.

FIG. 7 and FIG. 8 show a structure of a second tray in the prior art. A bottom plate of the tray 100 is provided with a plurality of small circular grooves 101 which are arranged corresponding to the shape of the bottom plate. FIG. 9 and FIG. 10 respectively show analysis diagrams of stress and strain obtained by ANSYS static compression simulation of the second tray under the condition of the same parameters as the aforementioned parameters. As shown in the Figures, the maximum stress of the second tray is 2.8023 MPa, and the maximum strain is 5.3194 mm.

FIG. 11 and FIG. 12 show a structure of a third tray in the prior art. A bottom plate of the tray 100 is provided with a plurality of small rectangular grooves 102 which are arranged side by side. FIG. 13 and FIG. 14 respectively show analysis diagrams of stress and strain obtained by ANSYS static compression simulation of the third tray under the condition of the same parameters as the aforementioned parameters. As shown in the Figures, the maximum stress of the third tray is 2.04 MPa, and the maximum strain is 5.9143 mm.

SUMMARY

In view of the above-described problems, the aim of the invention is to provide a tray for packaging LCD assemblies with the advantages of safety and reliability.

The aim of the invention is achieved by the following technical scheme.

A tray for packaging LCD assemblies comprises a bottom plate. The bottom plate is provided with a plurality of rhombic grooves which are arranged side by side, a plurality of discharge grooves for buffering stress concentration are arranged around the rhombic grooves, and the depth of the discharge grooves is less than that of the rhombic grooves. An oval groove is arranged in each of the rhombic grooves. Two opposite edges of two adjacent rhombic grooves are provided with the discharge grooves in the length direction of the tray, and peaks and edges of two adjacent rhombic grooves are provided with the discharge grooves in the width direction of the tray. The ends of the discharge grooves which are crossed in arrangement are mutually communicated.

The aim of the invention is further achieved by the following technical scheme. A tray for packaging LCD assemblies comprises a bottom plate. The bottom plate is provided with a plurality of rhombic grooves which are arranged side by side, and a plurality of discharge grooves for buffering stress concentration are arranged around the rhombic grooves.

Preferably, circular grooves are arranged in the rhombic grooves, thereby increasing the stress concentration of the rhombic grooves, and buffering the stress concentration in the center of the tray.

Preferably, the circular grooves are oval grooves. The stress concentration coefficient of the oval grooves is less than that of the ordinary circular grooves.

Preferably, the depth of the discharge grooves is less than that of the rhombic grooves, thereby generating stress concentration at the junctions of the discharge grooves and the rhombic grooves, and then buffering the stress concentration in the center of the rhombic grooves.

Preferably, the bottom plate of the tray is provided with three rows of the rhombic grooves which are arranged side by side. The rhombic grooves of the first row and the third row respectively comprise five rhombic grooves, and the rhombic grooves of the second row only comprise two rhombic grooves which are symmetrical relative to the central line of the tray. The arrangement adapts to the size requirement of most frequently-used LCD assemblies.

Preferably, two opposite edges of two adjacent rhombic grooves are provided with the discharge grooves in the length direction of the tray, and peaks and edges of two adjacent rhombic grooves are also provided with the discharge grooves in the width direction of the tray. Thus, a plurality of stress concentration factors is formed around the rhombic grooves to buffer the stress concentration in the center of the rhombic grooves.

Preferably, the ends of the discharge grooves which are crossed in arrangement are mutually communicated. Mutated buffer zones are formed among the discharge grooves to increase the discharge function of the discharge grooves.

Preferably, two opposite edges of two adjacent rhombic grooves on both sides of one rhombic groove are communicated by discharge grooves. Thus, mutual connection is formed, and the compression strength is increased.

Preferably, the discharge grooves are crossed mutually on the bottom plate to form a network structure. The formed network structure increases the compression strength.

Preferably, the network structure formed by the discharge grooves is of a rhombic structure. Thus, the overall structure of the tray tends to be symmetrical, thereby avoiding local stress concentration.

Because the bottom plate of the tray of the invention is designed with various types of stress concentration factors which are mutually associated, and the rhombic grooves of the stress concentration factors form a plurality of stress concentration zones on the bottom plate of the tray, the stress concentration in the center of the bottom plate can be effectively decreased. In addition, discharge grooves are arranged around the rhombic grooves of the invention, and the stress concentration in the region of the rhombic grooves is decreased by the discharge grooves. By the design of the aforementioned stress concentration factors, the stress and strain in the center of the bottom plate of the tray can be decreased, thereby preventing the tray from deforming largely because of excessive stress concentration to damage the LCD assemblies.

Legends: 100. tray; 120. buffer underlay; 200. LCD assemblies; 103. long rectangular groove; 101. small circular groove; 102. small rectangular groove; 110. rhombic groove; 111. circular groove; 112. discharge groove; 104. triangle slot; 105. connecting groove; 106. quadrangle groove.

DETAILED DESCRIPTION

The invention will further be described in detail in accordance with the figures and the preferable examples.

EXAMPLE 1

Figure 1:
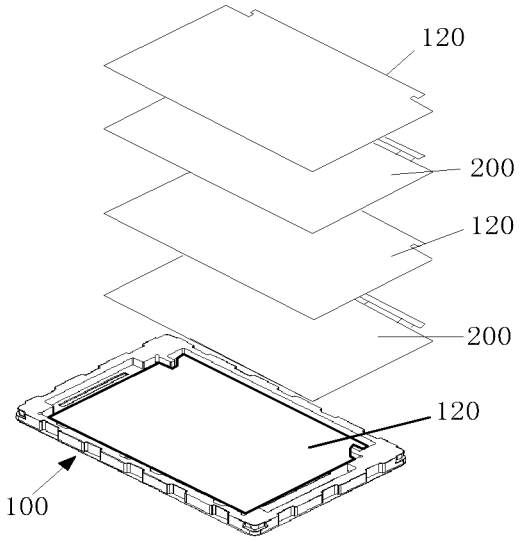
Figure 1 Prior Art
FIG. 1 is a schematic diagram of a conventional tray packaging LCD assemblies.
Figure 2:
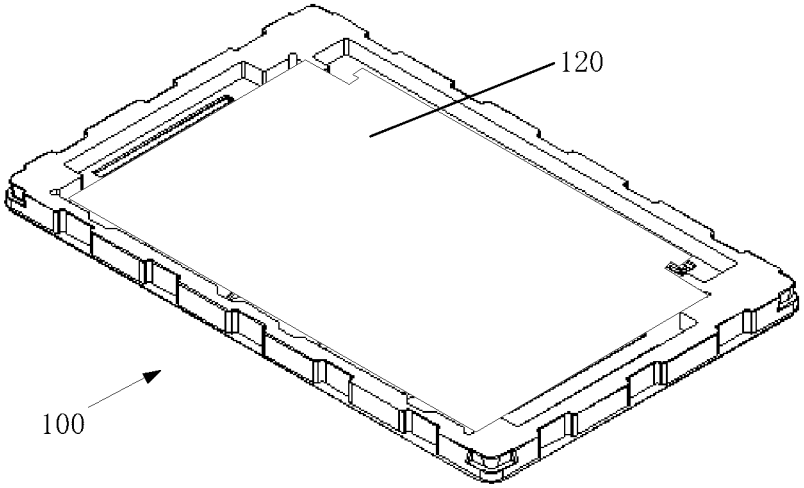
Figure 2 Prior Art
FIG. 2 is a schematic diagram of LCD assemblies packaged by a conventional tray.
Figure 3:
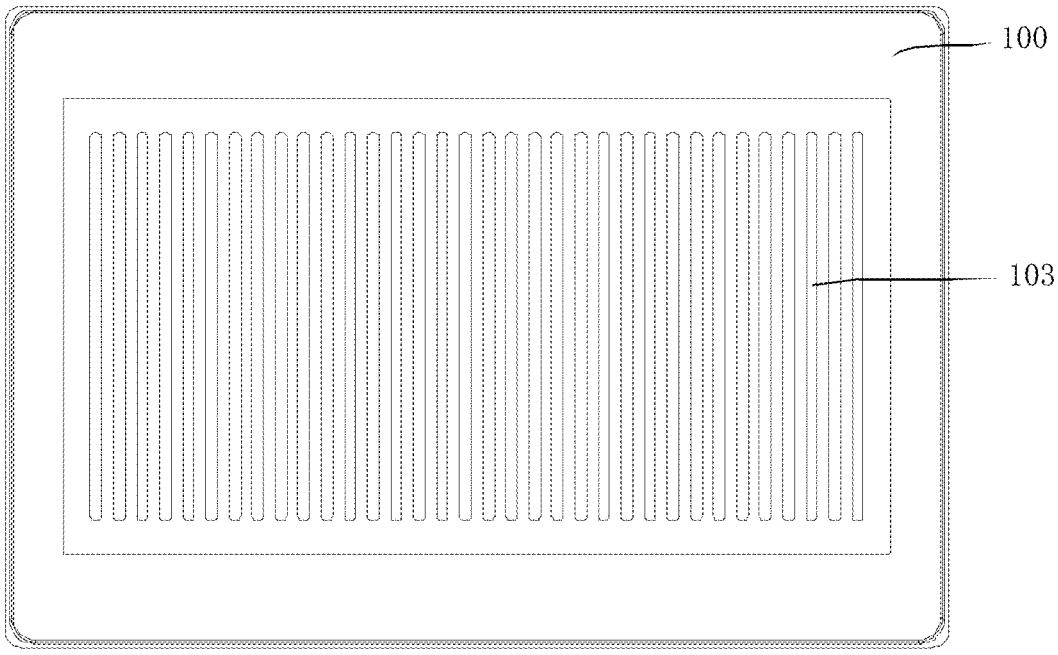
FIG. 3 is a plan diagram of a tray with strip-shaped textures.
Figure 4:
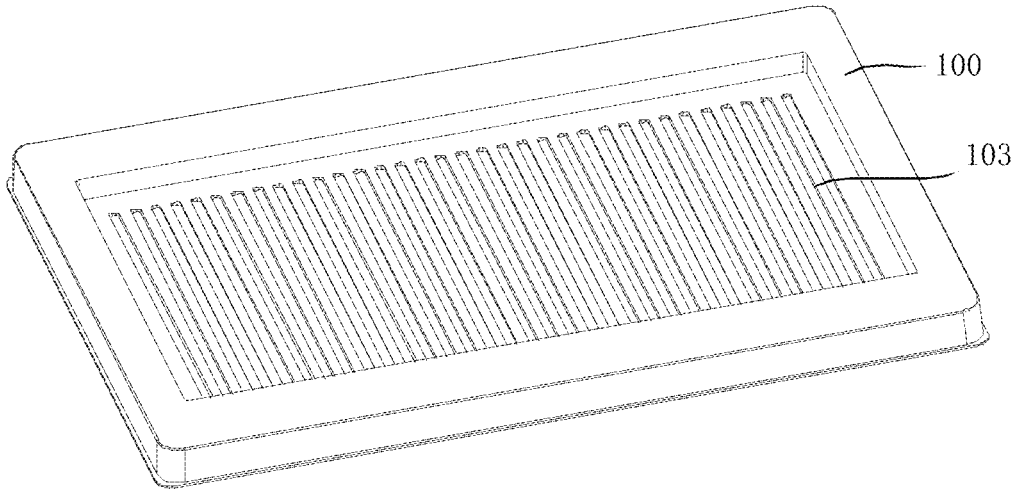
FIG. 4 is a simplified structure diagram of a tray with strip-shaped textures.
Figure 5:
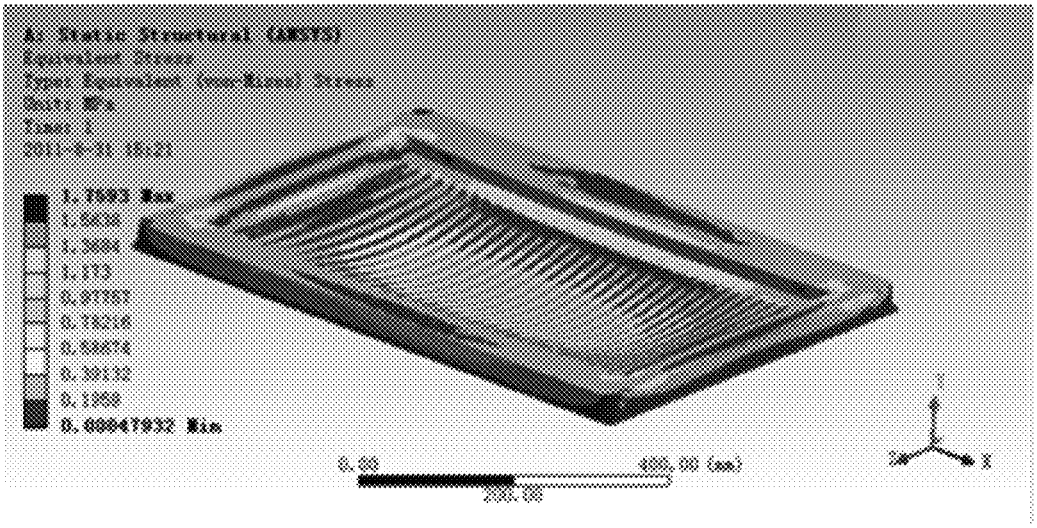
FIG. 5 is an analysis diagram of stress of a tray with strip-shaped textures.
Figure 6:
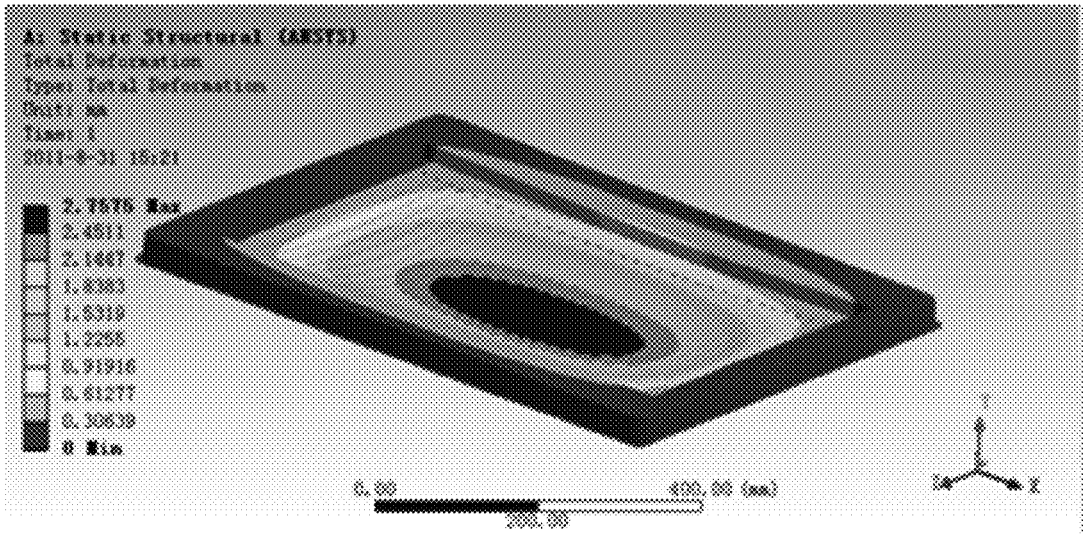
FIG. 6 is an analysis diagram of strain of a tray with strip-shaped textures.
Figure 7:
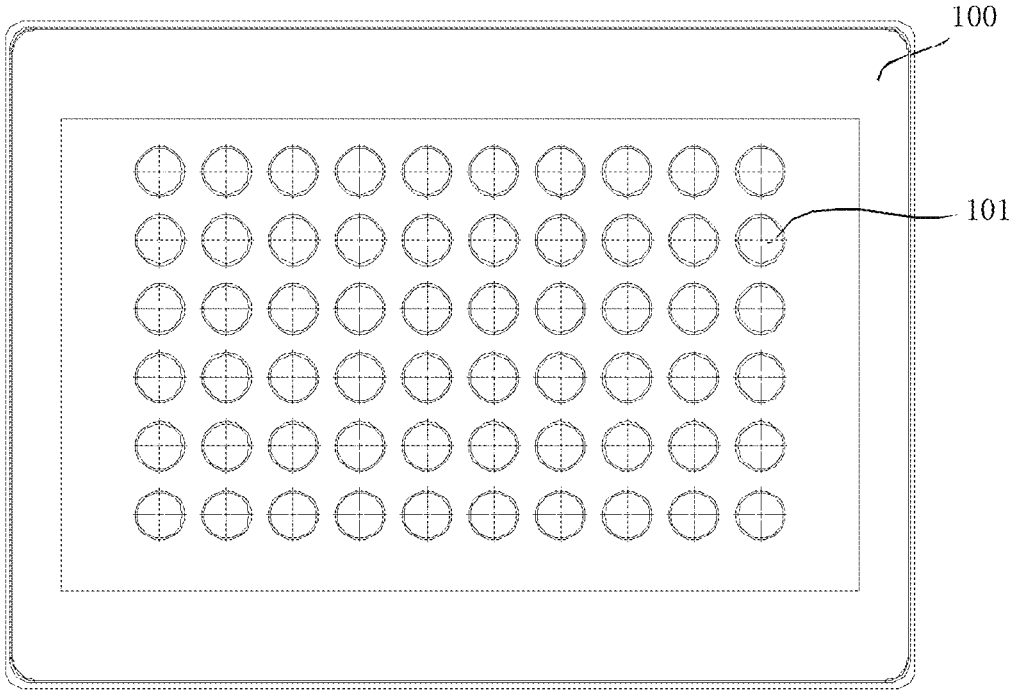
FIG. 7 is a plan diagram of a tray with circular textures.
Figure 8:
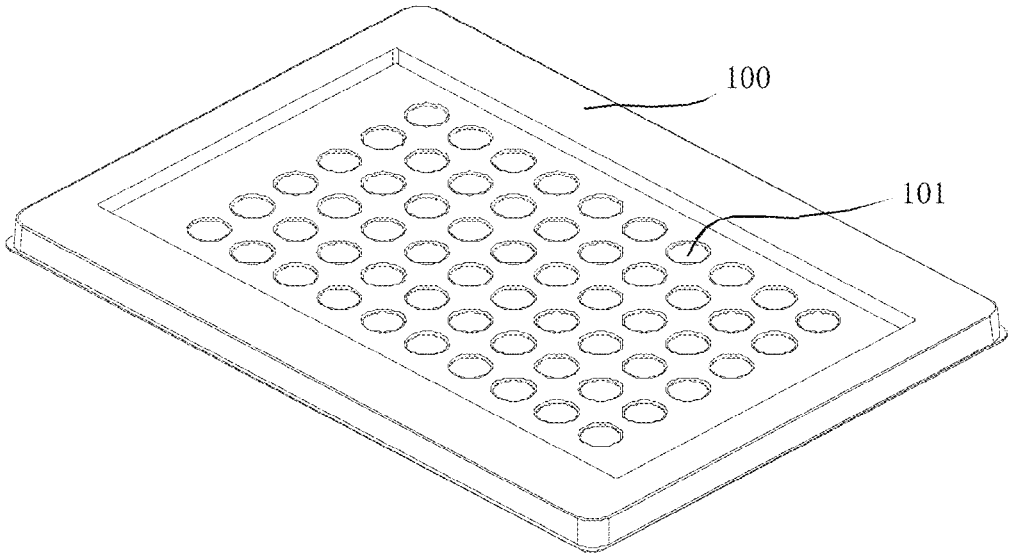
FIG. 8 is a three-dimensional structure diagram of a tray with circular textures.
Figure 9:
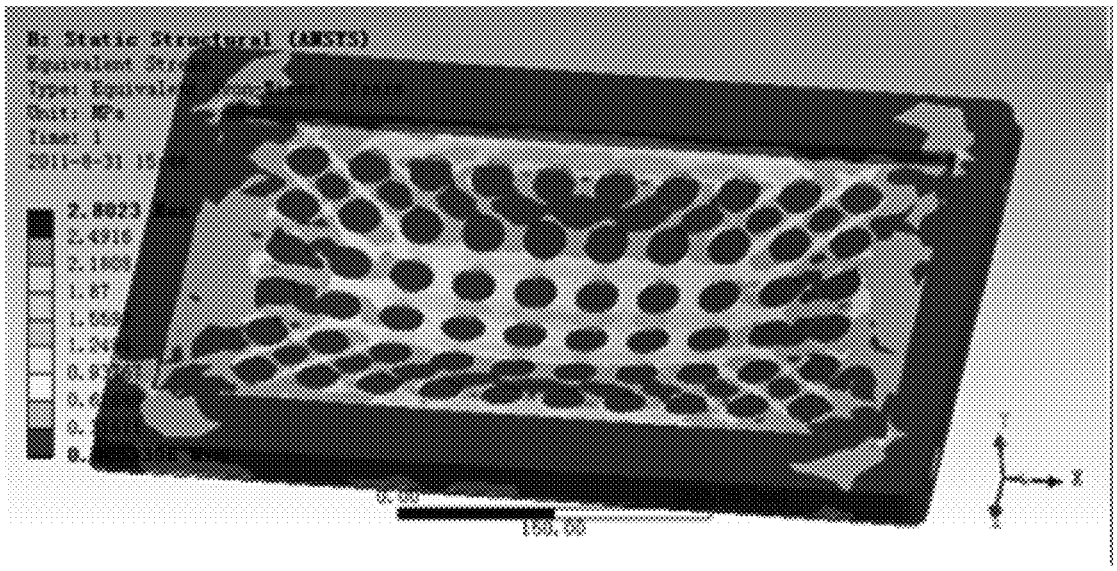
FIG. 9 is an analysis diagram of stress of a tray with circular textures.
Figure 10:
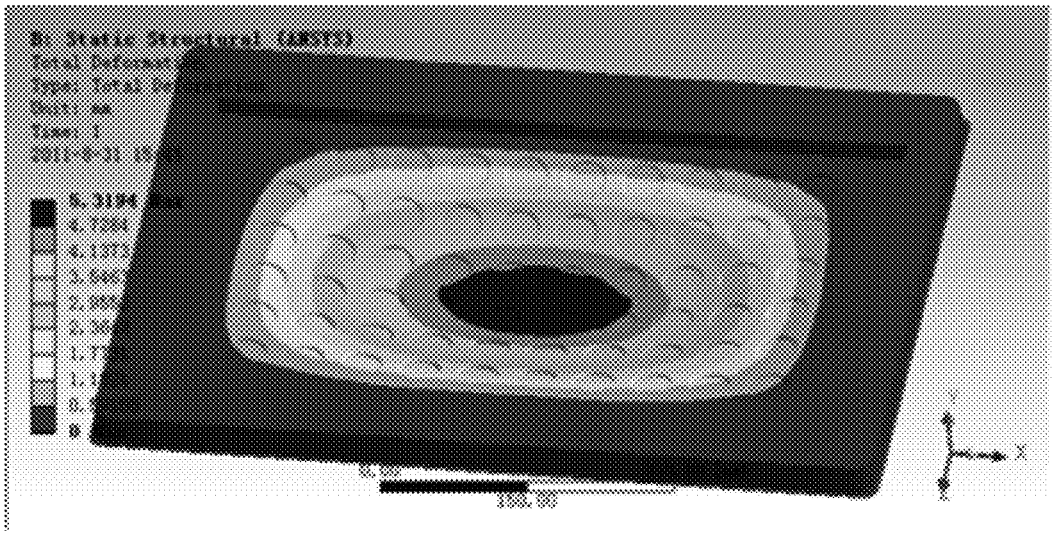
FIG. 10 is an analysis diagram of strain of a tray with circular textures.
Figure 11:
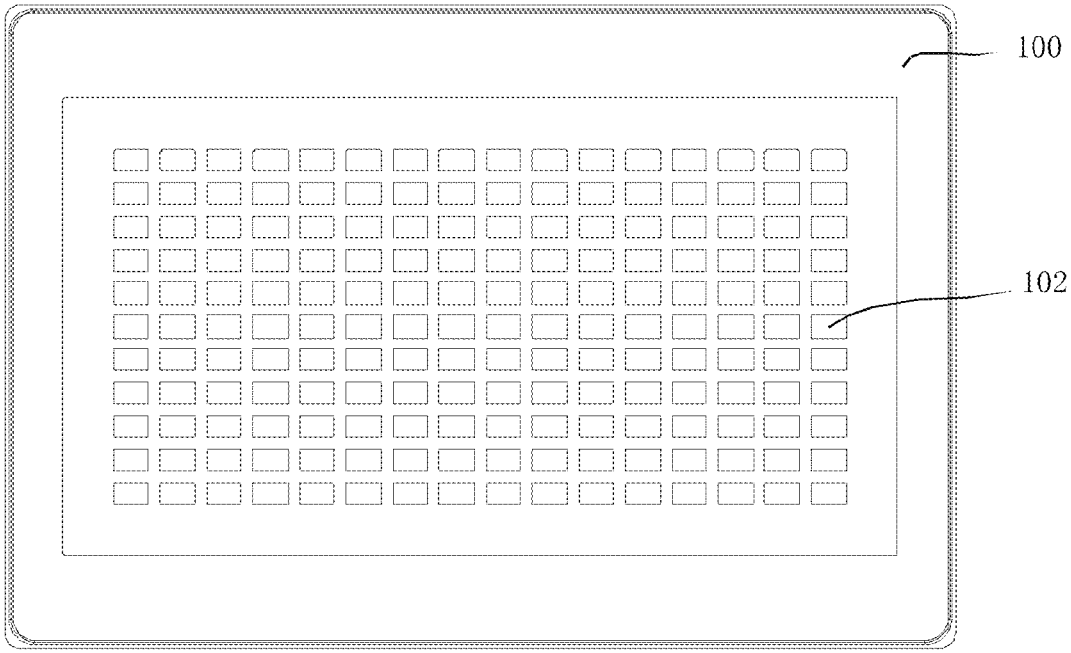
FIG. 11 is a plan diagram of a tray with rectangle textures.
Figure 12:
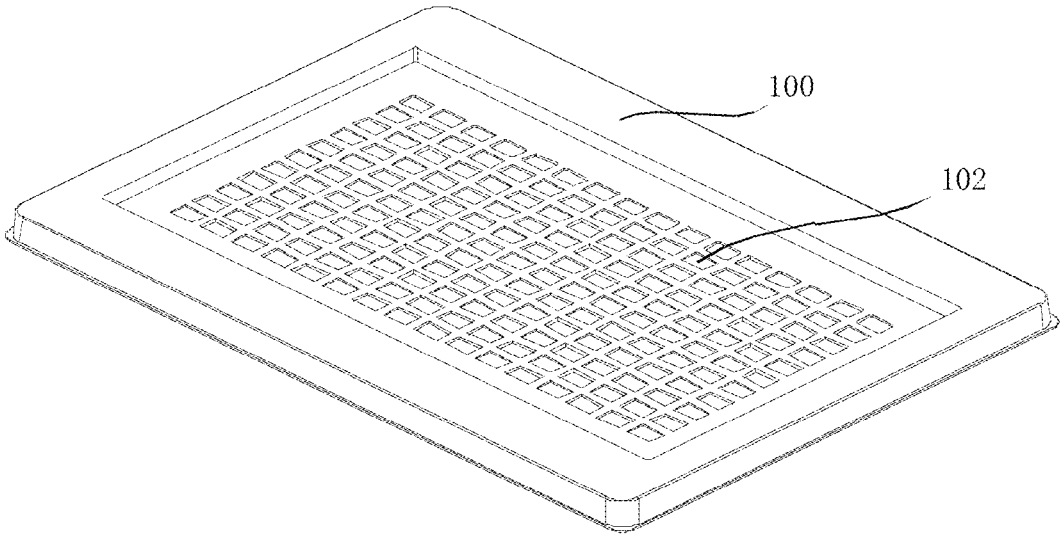
FIG. 12 is a simplified structure diagram of a tray with rectangle textures.
Figure 13:
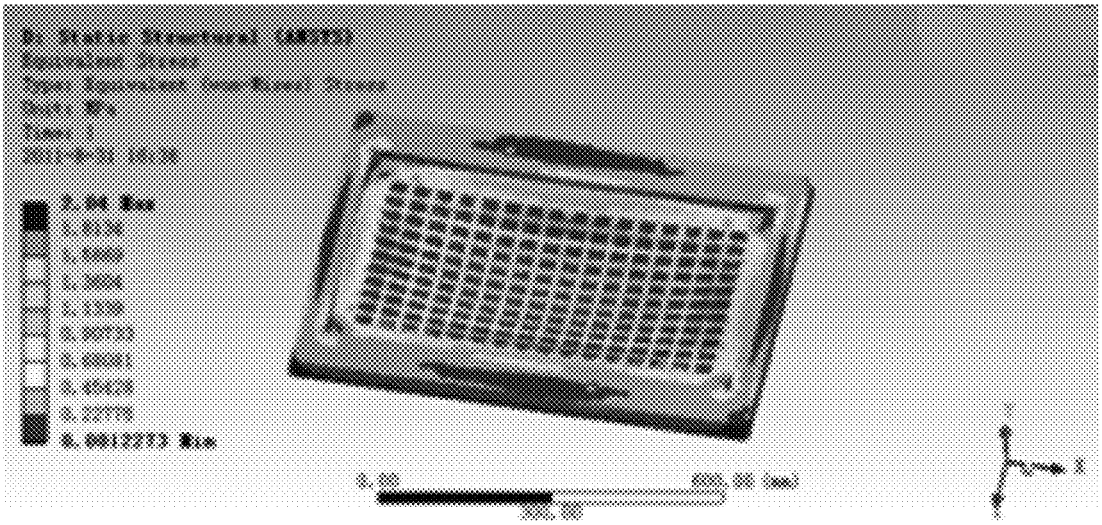
FIG. 13 is an analysis diagram of stress of a tray with rectangle textures.
Figure 14:
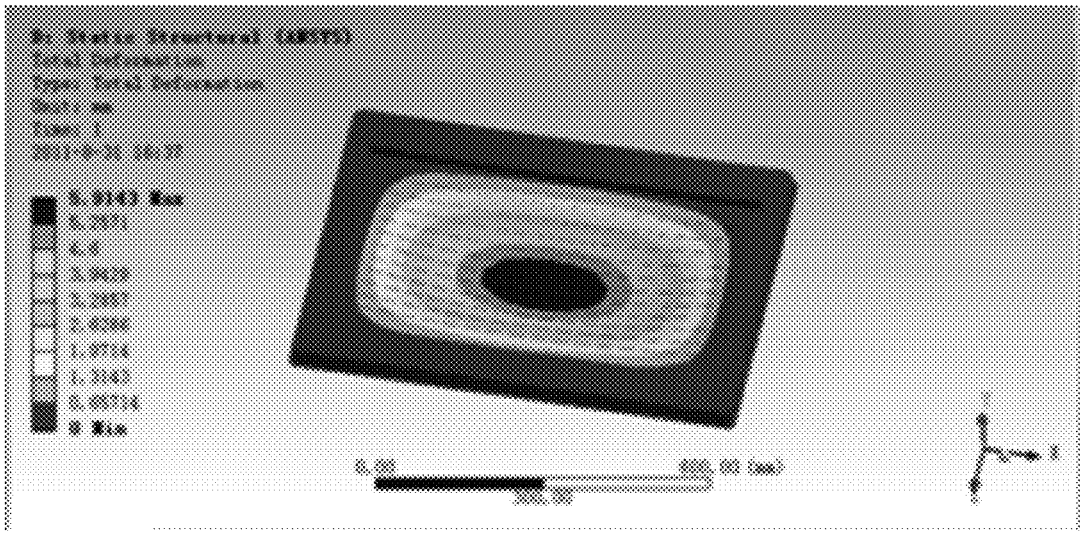
FIG. 14 is an analysis diagram of strain of a tray with rectangle textures.
Figure 15:
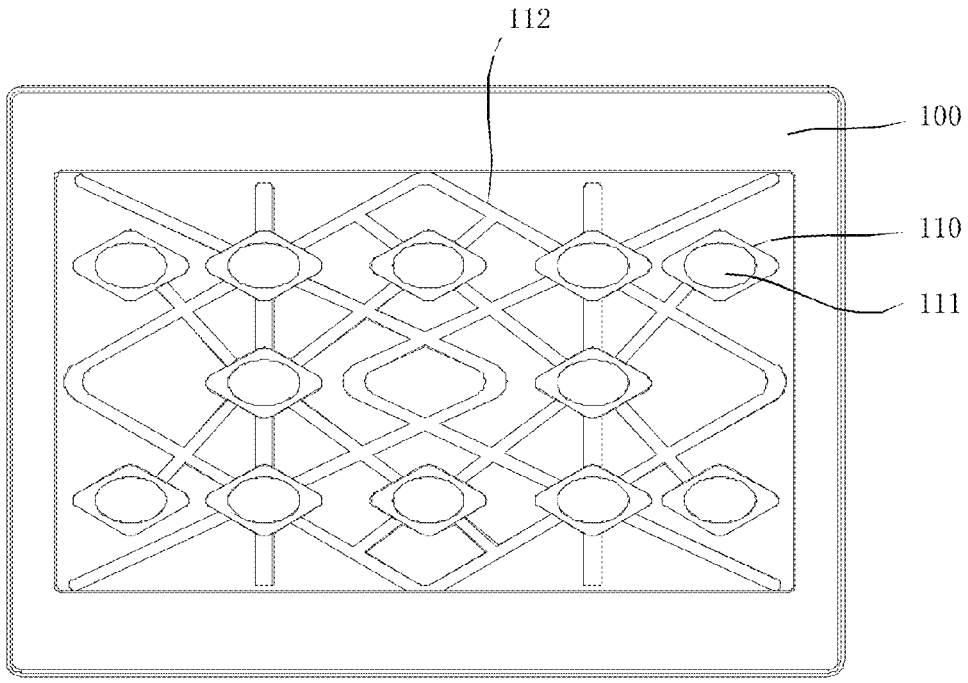
FIG. 15 is a plan diagram of a tray with textures formed by rhombic grooves and discharge grooves of a first example of the invention.
Figure 16:
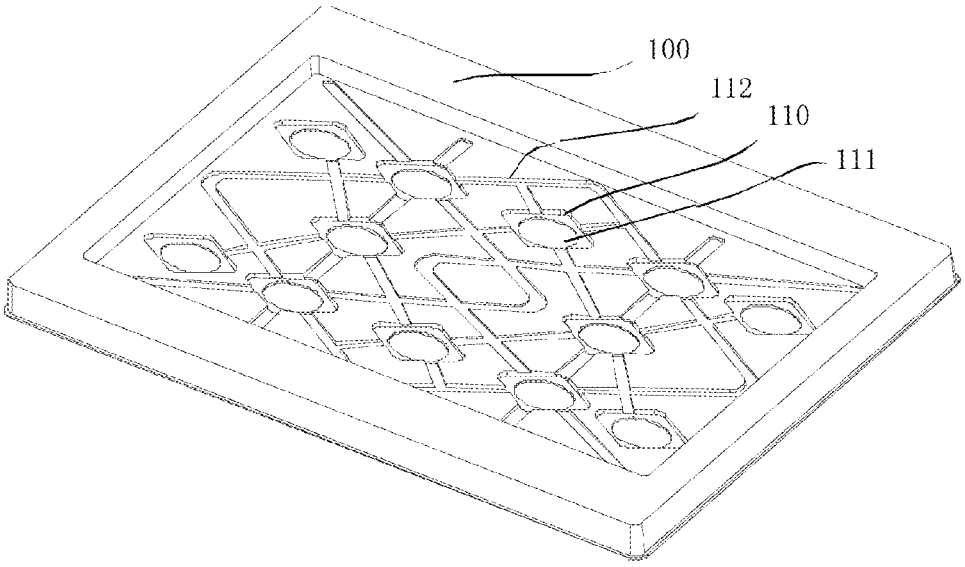
FIG. 16 is a simplified structure diagram of a tray with textures formed by rhombic grooves and discharge grooves of a first example of the invention.
Figure 17:
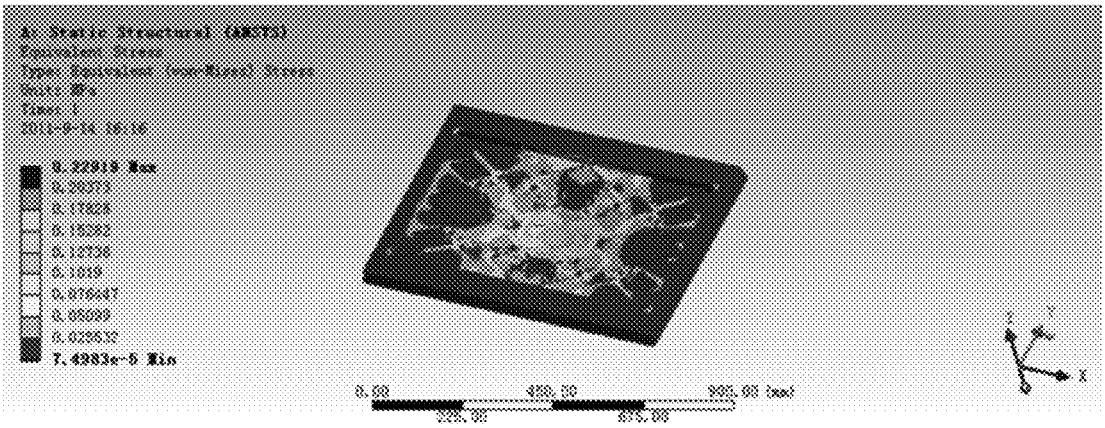
FIG. 17 is an analysis diagram of stress of a tray with textures formed by rhombic grooves and discharge grooves of a first example of the invention.
Figure 18:
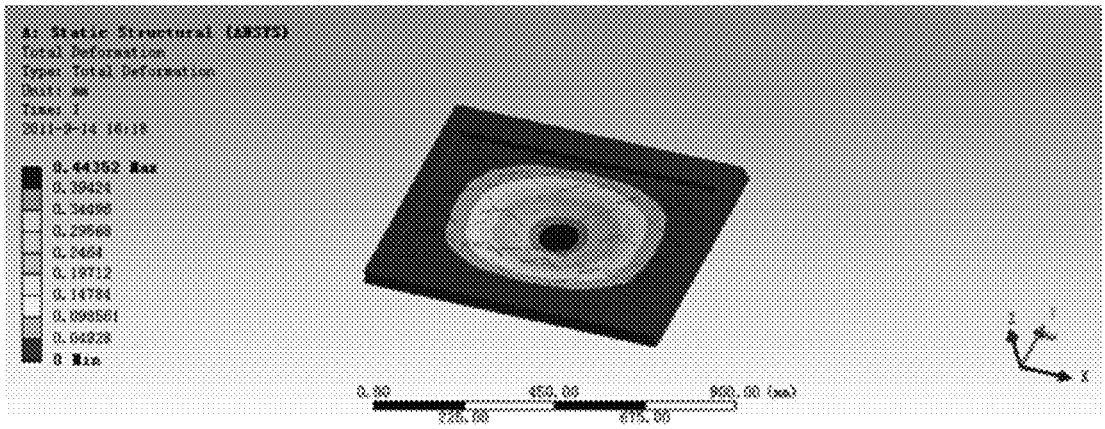
FIG. 18 is an analysis diagram of strain of a tray with textures formed by rhombic grooves and connecting grooves of a first example of the invention.

FIG. 15 and FIG. 16 show a first specific example of the invention. As shown in the Figures, a bottom plate of a tray 100 is provided with a plurality of stripes matched in shapes. The bottom plate comprises a plurality of rhombic grooves 110 which are arranged side by side on the bottom plate; the rhombic grooves 110 are mutually connected by a plurality of discharge grooves 112 extending to the edges of the bottom plate, and a circular groove 111 is arranged in each of the rhombic grooves 110. The shape mutation makes stress to concentrate in the mutation zone. The stress and strain in the center of the bottom plate of the tray 100 are decreased by arranging reasonable stress concentration factors in the corresponding place of the bottom plate of the tray 100 and setting corresponding number of the stress concentration factors.

In the example, a plurality of stress concentration zones are formed on the bottom plate of the tray 100 by a plurality of stress concentration factors, i.e. the rhombic grooves 110, to decrease the stress concentration in the center of the bottom plate. Moreover, the rhombic grooves 110 are not arranged in the center of the tray to avoid the stress concentration in the center caused by mutation. Stress concentration factors, i.e. the circular grooves 111 are also arranged in the rhombic grooves 110, to improve the stress concentration of the rhombic grooves 110 and the stress distribution of the rhombic grooves 110. Thus, the stress concentration in the center of the tray can be further decreased.

In the example, the discharge grooves 112 used for buffering the stress concentration of the rhombic grooves 110 are arranged around the rhombic grooves 110. Because the distance between every two rhombic grooves 110 is short, the discharge grooves 112 which are crossed in multiple directions are mutually communicated, to prevent the ends of the discharge grooves from forming more cross section mutations, to avoid forming non-uniform stress mutation factors and reducing the discharge effect of the discharge grooves 112. The depth of the discharge grooves 112 is less than that of the rhombic grooves 110, thereby generating stress concentration at the junctions of the discharge grooves 112 and the rhombic grooves 110, and thus buffering the stress concentration in the center of the rhombic grooves 110.

Two opposite edges of two adjacent rhombic grooves 110 are connected by the discharge grooves 112 in the length direction of the tray 100, and peaks and edges of two adjacent rhombic grooves are connected by the discharge grooves 112 in the width direction of the tray 100. Thus, a plurality of stress concentration factors are formed around the rhombic grooves 110, which decreases the stress concentration in the center of the rhombic grooves 110. Two opposite edges of two adjacent rhombic grooves 110 on both sides of one rhombic groove 110 are also connected by the discharge grooves 112. Thus, mutual connection is formed, and the compression strength is increased. The discharge grooves 112 are crossed mutually to form a network structure on the bottom plate to increase the compression strength. As shown in the Figure, the arrangement of the discharge grooves 112 arranged on the bottom plate of the tray are of a rhombic structure. Thus, the overall structure of the tray tends to be symmetrical, thereby avoiding local stress concentration.

In the example, the bottom plate of the tray is provided with three rows of rhombic grooves 110 which are arranged side by side, the rhombic grooves 110 of the first row and the third row respectively comprise five rhombic grooves 110, and the rhombic grooves 110 of the second row only comprise two rhombic grooves 110 which are symmetrical relative to the central line of the tray 100, namely no rhombic grooves 110 are arranged in the center of the tray 100. The arrangement adapts to the size requirement of most frequently-used LCD assemblies. For large-size LCD assemblies, the arrangement number of the rhombic grooves can be correspondingly adjusted as required, to decrease the stress and strain in the center of the tray.

In the example, the circular grooves 111 can be oval grooves. The length direction of the oval grooves is the same as that of the tray 100. Under the condition, the stress concentration coefficient (stress concentration coefficient refers to a ratio of bearing alternating stress of a material to the ultimate strength under static load) is superior to that of the circular grooves.

FIG. 15 and FIG. 16 show a structure of a tray of the example. Static compression simulation is performed on the tray 100 by ANSYS under the condition of the parameters as described in the background part of the specification, namely, poisson ratio of 0.41, elastic modulus of 2,200 MPa, mesh size of 15 mm, applying fixed constraints to the bottom surface, and applying pressure of 0.00016 Mpa to the plane of the bottom plate. The analysis diagrams of stress and strain obtained by ANSYS static compression simulation are shown in the figures. The maximum stress of the tray is 0.22919 MPa, and the maximum strain is 0.44352 mm.

Various stress concentration factors arranged on the bottom plate of the tray 100 of the example are symmetrical relative to the central lines of the bottom plate in the length direction and width direction.

Therefore, because the bottom plate of the tray of the invention is designed with various types of stress concentration factors which are mutually associated, and the rhombic grooves of the stress concentration factors form a plurality of stress concentration zones on the bottom plate of the tray, thus the stress and strain in the center of the bottom plate can be effectively decreased. Moreover, the circular groove are additionally arranged in the rhombic grooves to increase the stress concentration of the rhombic grooves, and further decrease the stress and strain in the center of the bottom plate. In addition, the discharge grooves for buffering the stress concentration of the rhombic grooves are arranged around the rhombic grooves in the invention, and the stress and strain of the rhombic grooves are decreased by the discharge grooves. By the design of the aforementioned stress concentration factors, the stress and strain in the center of the bottom plate of the tray can be decreased, and then the tray can be prevented from deforming largely because of excessive stress concentration to damage the LCD assemblies.

EXAMPLE 2

Figure 19:
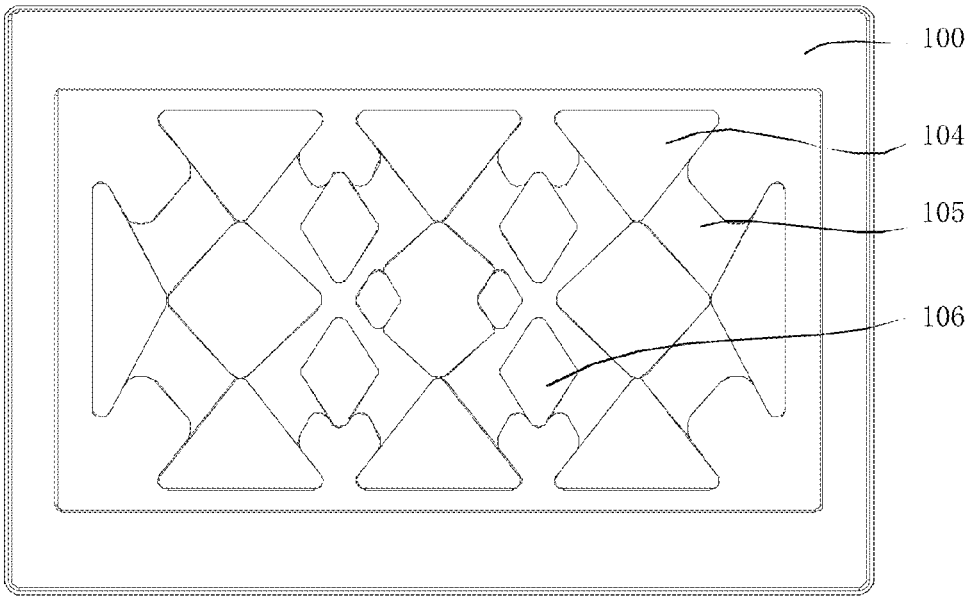
FIG. 19 is a plan diagram of texture of a tray with textures formed by triangles and quadrangles of a second example of the invention.
Figure 20:
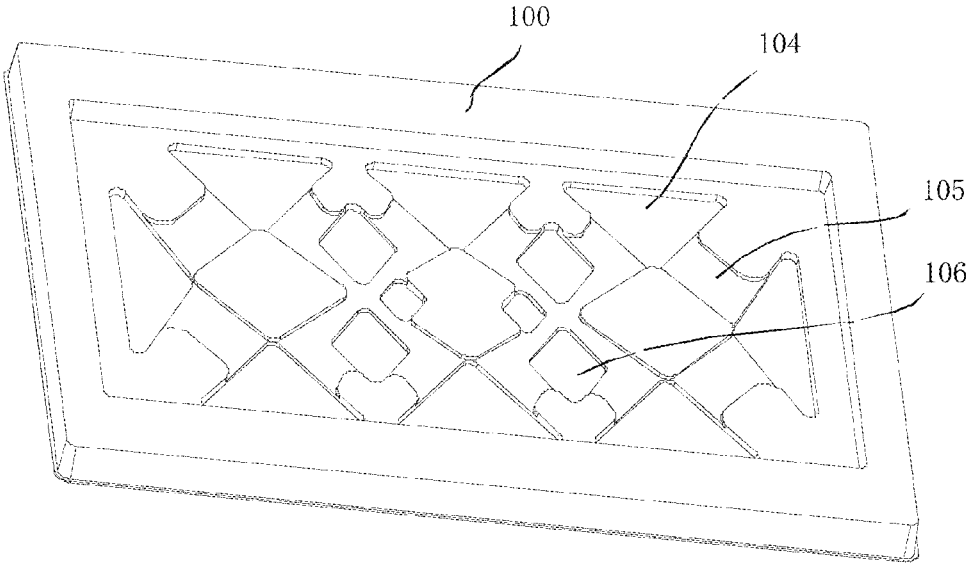
FIG. 20 is a simplified structure diagram of a tray with textures formed by triangles and quadrangles of a second example of the invention.

FIG. 19 and FIG. 20 show a second example of the invention. Take a small and medium size tray as an example, as shown in the figures, a bottom plate of the tray 100 is provided with three triangle slots 104 in the upper part and the lower part close to the edges in the length direction, and is provided with one triangle slot 104 in the left and right parts close to edges in the width direction. The internal zones surrounded by the triangle slots 104 are provided with quadrangle grooves 106. The triangle slots 104 are communicated by connecting grooves 105 for discharge, and the triangle slots 104 and the quadrangle grooves 106 are also communicated by the connecting grooves 105 for discharge. The triangle slots 104 and the quadrangle grooves 106 form a plurality of stress concentration zones on the bottom plate, to decrease the stress and strain in the center of the tray. The connecting grooves 105 are used for buffering the stress concentration of the triangle slots 104 and the quadrangle grooves 106. No stress concentration factors are arranged in the center of the bottom plate, to avoid generating large stress concentration in the center of the bottom plate.

Figure 21:
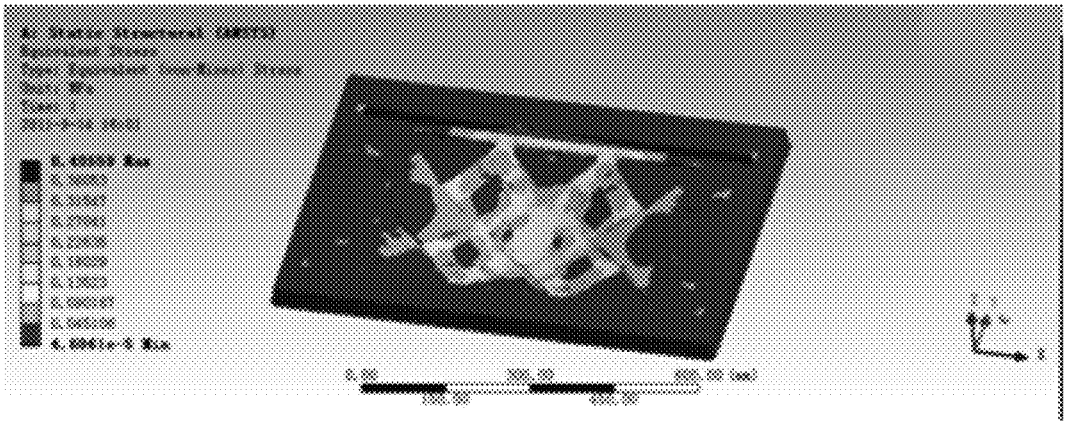
FIG. 21 is an analysis diagram of stress of a tray with textures formed by triangles and quadrangles of a second example of the invention.
Figure 22:
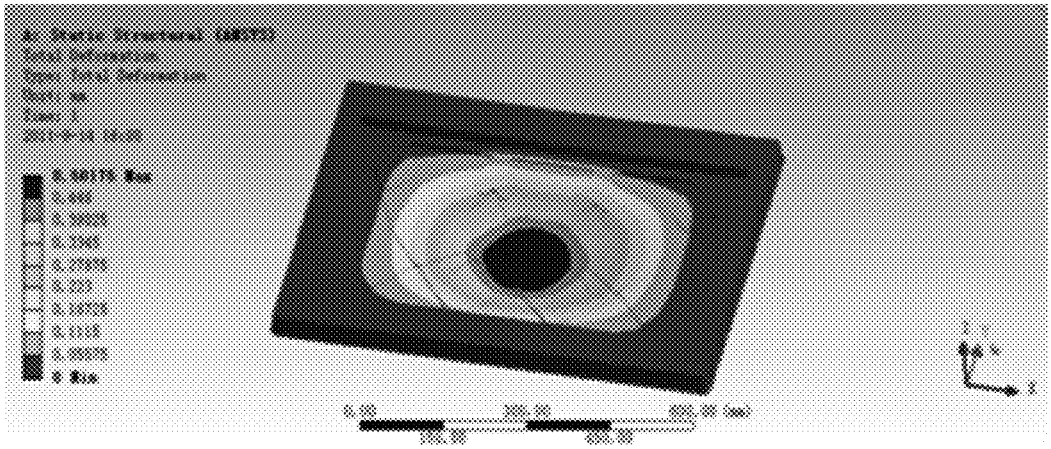
FIG. 22 is an analysis diagram of strain of a tray with textures formed by triangles and quadrangles of a second example of the invention.

Static compression simulation is performed on the tray of the second example by ANSYS under the condition of the same parameters as those used in the simulation of the first example. FIG. 21 and FIG. 22 show analysis diagrams of stress and strain of the second example. As shown in the figures, the maximum stress of the tray of the second example of the invention is 0.40559 MPa, and the maximum strain is 0.50175 mm.

The following table is a comparison of the maximum stress and maximum strain of several trays described in the two examples and the background part of the invention.

| | Simulation Items | |
|---|---|---|
| Internal Structure | Maximum Stress (MPa) | Maximum Strain (mm) |
| Conventional First Tray | 1.7593 | 2.7575 |
| Conventional Second Tray | 2.8023 | 5.3194 |
| Conventional Third Tray | 2.04 | 5.9143 |
| Tray of the First Example of the Invention | 0.22919 | 0.44352 |
| Tray of the Second Example of the Invention | 0.40559 | 0.50175 |

As shown in the aforementioned table, the maximum stress and the maximum strain of the trays of the two examples of the invention are superior to those of the conventional three trays. The structure of the tray of the first example of the invention is a preferable structure, and the maximum stress and maximum strain thereof are the minimum.

The invention is described in detail in accordance with the above contents with the specific preferred examples. However, this invention is not limited to the specific examples. For the ordinary technical personnel of the technical field of the invention, on the premise of keeping the conception of the invention, the technical personnel can also make simple deductions or replacements, and all of which should be considered to belong to the protection scope of the invention.

I claim:

1. A tray for packaging LCD assemblies, comprising: a bottom plate; wherein said bottom plate is provided with a plurality of rhombic grooves which are arranged side by side, the bottom plate of the tray is designed with corresponding textures, the bottom plate and the textures are engaged to form the plurality of rhombic grooves; a plurality of discharge grooves for buffering stress concentration are arranged around said rhombic grooves, and a depth of said discharge grooves is less than that of said rhombic grooves; an oval groove is arranged in each of said rhombic grooves; two opposite edges of two adjacent rhombic grooves are provided with the discharge grooves in a length direction of said tray, and peaks and edges of two adjacent rhombic grooves are also provided with the discharge grooves in a width direction of said tray; and ends of said discharge grooves which are crossed in arrangement are interconnected.

2. A tray for packaging LCD assemblies, comprising: a bottom plate; wherein said bottom plate is provided with a plurality of rhombic grooves which are arranged side by side, the bottom plate of the tray is designed with corresponding textures, the bottom plate and the textures are engaged to form the plurality of rhombic grooves, and a plurality of discharge grooves for buffering stress concentration are arranged around said rhombic grooves, and wherein a circular groove is arranged in each of said rhombic grooves.

3. The tray for packaging LCD assemblies of claim 2, wherein said circular grooves are oval grooves.

4. The tray for packaging LCD assemblies of claim 2, wherein a depth of said discharge grooves is less than that of said rhombic grooves.

5. The tray for packaging LCD assemblies of claim 2, wherein the bottom plate of said tray is provided with three rows of the rhombic grooves which are arranged side by side, said rhombic grooves of a first row and a third row respectively comprise five rhombic grooves, and said rhombic grooves of a second row only comprise two rhombic grooves which are symmetrical relative to a central line of said tray.

6. The tray for packaging LCD assemblies of claim 2, wherein two opposite edges of two adjacent rhombic grooves are provided with the discharge grooves in a length direction of said tray, and peaks and edges of two adjacent rhombic grooves are also provided with the discharge grooves in a width direction of said tray.

7. The tray for packaging LCD assemblies of claim 6, wherein ends of said discharge grooves which are crossed in arrangement are interconnected.

8. The tray for packaging LCD assemblies of claim 6, wherein two opposite edges of two adjacent rhombic grooves on both sides of one rhombic groove are interconnected by the discharge grooves.

9. The tray for packaging LCD assemblies of claim 8, wherein said discharge grooves are crossed mutually on said bottom plate to form a network structure.

10. The tray for packaging LCD assemblies of claim 9, wherein the network structure formed by said discharge grooves is of a rhombic structure.

11. A tray for packaging LCD assemblies, comprising: a bottom plate;

wherein said bottom plate is provided with a plurality of rhombic grooves which are arranged side by side, the bottom plate of the tray is designed with corresponding textures, the bottom plate and the textures are engaged to form the plurality of rhombic grooves, and a plurality of discharge grooves for buffering stress concentration are arranged around said rhombic grooves, wherein two opposite edges of two adjacent rhombic grooves are provided with the discharge grooves in the length direction of said tray, and peaks and edges of two adjacent rhombic grooves are also provided with the discharge grooves in the width direction of said tray.

12. The tray for packaging LCD assemblies of claim 11, wherein ends of said discharge grooves which are crossed in arrangement are interconnected.

13. The tray for packaging LCD assemblies of claim 11, wherein two opposite edges of two adjacent rhombic grooves on both sides of one rhombic groove are interconnected by the discharge grooves.

14. The tray for packaging LCD assemblies of claim 13, wherein said discharge grooves are crossed mutually on said bottom plate to form a network structure.

15. The tray for packaging LCD assemblies of claim 14, wherein the network structure formed by said discharge grooves is of a rhombic structure.

* * * * *